United States Patent [19]

Auer

[11] 3,964,154

[45] June 22, 1976

[54] DEVICE FOR SIMULTANEOUSLY STRESSING A NUMBER OF TENSION ELEMENTS

[75] Inventor: Peter Auer, Ottobrunn, Germany

[73] Assignee: Dyckerhoff & Widmann Aktiengesellschaft, Munich, Germany

[22] Filed: June 30, 1975

[21] Appl. No.: 591,328

[30] Foreign Application Priority Data

July 10, 1974 Germany ..... 2433035

[52] U.S. Cl. ..... 29/452; 81/52.4 R; 81/57.38; 81/57.22

[51] Int. Cl.[2] ..... B21D 39/00

[58] Field of Search ..... 29/446, 452; 81/52.4 R, 81/57.38, 57.36, 57.22

[56] References Cited

UNITED STATES PATENTS

| | | | |
|---|---|---|---|
| 2,069,882 | 2/1937 | Hall | 81/57.22 |
| 2,736,219 | 2/1956 | May | 29/446 |
| 3,287,999 | 11/1966 | Krecker | 81/57.36 |
| 3,847,041 | 11/1974 | Meschonat et al. | 81/57.38 |

*Primary Examiner*—James L. Jones, Jr.
*Attorney, Agent, or Firm*—Toren, McGeady and Stanger

[57] ABSTRACT

In a device for simultaneously stressing a group of tension elements in a prestressed concrete member, a common driving source is used for mechanically rotating each of the spindles and wrench sleeves which are connectible to the tension elements. Separate safety clutches are selectively engageable with each of the spindles and wrench sleeves so that individual connection of each spindle to a tension element can be provided and, as the element is stressed in tension, individual adjustment can be provided by the wrench sleeve for each anchor nut on its associated tension element.

3 Claims, 2 Drawing Figures

DEVICE FOR SIMULTANEOUSLY STRESSING A NUMBER OF TENSION ELEMENTS

SUMMARY OF THE INVENTION

The present invention is directed to a device for simultaneously stressing a group of tension elements, preferably rod-shaped elements, in a prestressed concrete element, the device includes a mechanically rotatable spindle for each stressing point to connect the tension element to an hydraulic press and a mechanically driven wrench sleeve for tightening the anchor nut on the tension element corresponding to the extent the element is elongated in the stressing action. More particularly, the invention concerns the arrangement of safety clutches associated with each of the spindles and wrench sleeves to afford individual driving action to each of them.

When threaded tension rods are stressed, the tensioning forces are transmitted to the concrete by anchor nuts which bear on concrete anchor elements positioned on the ends of the rods. The end of the tension rod projecting outwardly through its anchor nut is engaged by an hydraulic press so that the rod can be stretched. During the stretching action, the anchor nut threaded on the rod is displaced from its seat against the anchor element. To transmit the tensional forces developed by stretching the tension rod to the concrete, the anchor nut must be tightened into engagement with the anchor element. As the tension rod is stretched it moves the anchor nut a certain distance away from the anchor element and the nut must be tightened over that distance to transmit the stressing action to the concrete. To provide effective stressing of the tension element assemblies in the production of prestressed concrete members, it is known, for example, in the production of prestressed concrete ties, to combine a group of tensioning devices, in particular four individual presses, in a so-called quadruple tensioning device. In such a device, when the rotary movement is transmitted to the spindles, which effect the connection between the tension element and the piston of the hydraulic press, and to the wrenches by a single drive, it is difficult to ensure an exact starting point for all the spindles at the commencement of the tensioning operation, since the projecting ends of the individual tension elements are generally unequal in dimension with the result that the spindles do not act simultaneously on the tension elements. Usually each spindle is driven a different distance onto its associated tension element until it bears on the anchor nut and this engagement is necessary to introduce into each tension element exactly the same amount of elongation and thus the same tensional force. Accordingly, the practice has been to attach and thread each spindle individually onto its tension element.

The primary object of the present invention is to provide a tensioning device which assures, practically automatically, equal conditions for all of the tension elements when a group of them are being stressed by a single device without requiring elaborate manual work in effecting the engagement and elongation of the tension elements and without causing any damage to the elements or the concrete member being prestressed.

In accordance with the present invention, while the device provides a single drive means for each of the tension elements being stressed, each spindle and each wrench sleeve associated with a single tension element has its own safety clutch for transmitting the requisite rotary movement.

When the common drive is used in this device, because of the use of the safety clutches, each spindle can be threaded onto the associated tension element until it bears against the anchor nut. With a separate safety clutch on each of the spindles, the rotary driving movement is continued until the spindle attached to the tension element having the longest projecting end is threaded into engagement with the anchor nut. This insures not only a better working result, because unequal stresses or overstressing of the tension element or the prestressed concrete part are avoided but it also affords a more economical and simpler operation, since the spindles no longer require manual adjustment. As a result, it is possible to use unskilled workers for operating the device of the present invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
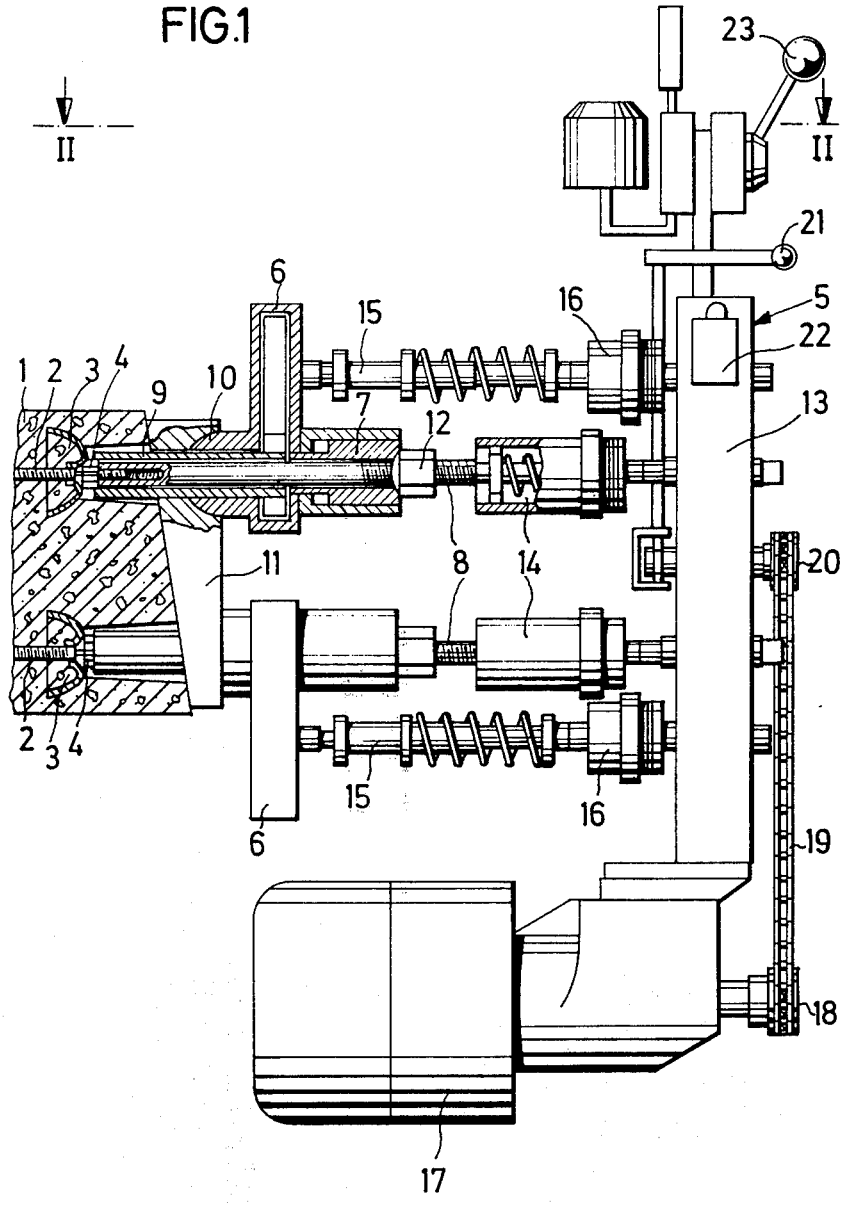
FIG. 1 is a side view, partly in section, of a device embodying the present invention secured to tension elements in a concrete member.

In the drawing the device embodying the present invention is represented as attached to one end of a prestressed concrete tie in which four stressing points are provided, that is, four tension elements. However, the number of tension elements to be stressed and the type of concrete member within which the tension elements are located are not important with regard to the basic inventive concept.

Figure 2:
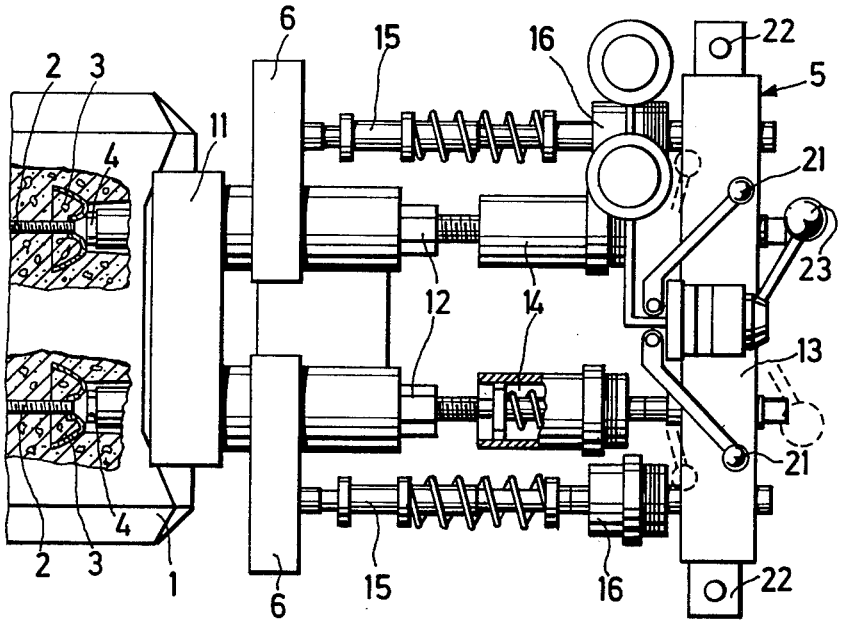
FIG. 2 is a view, partly in section, taken along the line II—II in FIG. 1.

In FIGS. 1 and 2 one end of a concrete railroad tie 1 which is to be prestressed is shown. Four longitudinally extending tension rods extend through the tie with two of the rods located in the upper portion of the tie above the other two rods arranged in the lower portion of the tie. Each of the tension rods 2 includes a concrete anchor element 3 and an anchor nut 4 which bears against the anchor element. The combination of the anchor element 3 and anchor nut 4 transmits the tensional force produced by the stretching of the threaded tension rods 2 as pressure to the anchor elements 3 and from the elements to the concrete.

The tensioning device 5 includes four prestressing jacks or pullers 6. Each jack 6, in addition to an hydraulic piston 7, has a spindle 8 and a wrench sleeve 9. Each of the pullers 6 has a shoulder 10 bearing against a wedge-shaped block 11 which, in turn, bears directly on the end of the tie 1. Each spindle 8 is provided with a female thread on one end which can be threaded onto the end of the tension rod 2 projecting through its anchor element 3 and anchor nut 4. The spindle extends from the end of the tie 1 through the puller 6 and a spindle nut 12 at its opposite end bears against the hydraulic piston 7. A gear arrangement is provided in a box 13 for driving the spindle 8 and a safety or slip clutch 14 is provided between the spindle and the box. The wrench sleeve 9 laterally encloses the spindle 8 between the puller 6 and the anchor nut 4. Its end extending into the tie is arranged so that it can be attached to the anchor nut 4. A shaft 15 drives the wrench sleeve 9. The shaft 15, in turn, is driven via the gear box 15 and a safety or slip clutch 16 is also provided between the shaft 15 and the gear box 13.

An electromotor 17 acts as the common drive source for each of the spindles and the wrench sleeves. A gear wheel 18 driven by the electromotor 17 drives a roller chain 18 which, in turn, drives an input gear wheel 20 of the gear box 13. The gear box is arranged to drive each of the spindles 8 and the wrench sleeves 9. By means of two switch levers 21 the driving action afforded through the gear box can be switched either to the spindles or to the wrench sleeves. Further, the electromotor 17 can be reversible so that rotary movement in the opposite directions can be obtained. The reversal of the driving action is effected by the push buttons 22.

After the device 5 has been mounted on the head of the tie 1 the device is operated in the following manner.

Initially, by means of the operating levers 21, the driving action from the electromotor 17 is transmitted over the chain 19 through the gear box 13 to the spindles 8 and since each spindle is connected to the gear box by a safety or slip clutch 14, it is possible to thread the end of each spindle onto the corresponding tension rod into contact with the anchor nut 4 thereon. The drive is effected over the four safety clutches 14. When the desired contact of the spindle with the anchor nut 4 is achieved the clutch associated with the spindle will disengage and discontinue the driving action. Subsequently, by operating switch levers 21, the driving action is switched over to the wrench sleeves 9 with the rotation of the sleeves being effected by a safety clutch 16 for each of the sleeves. By simultaneously operating a lever 23 for an hydraulic pump, not shown, hydraulic pressure is supplied to the pistons 7 of the pullers 6. As the hydraulic pistons 7 pull the spindles which in turn pull the tension rods, there is the tendency for the anchor nuts 4 to be displaced with the tension rods away from the anchor elements 3. However, the wrench sleeves 9 tighten the anchor nuts against the anchor elements to assure a satisfactory anchorage of the tension rods within the tie. As the elongation of the individual tension rods is achieved and the tightening of the anchor nuts completed, each of the safety or slip clutches provides a disengagement of the driving means to ensure the proper and independent readjustment of the anchor nuts 4.

While a specific embodiment of the invention has been shown and described in detail to illustrate the application of the inventive principles, it will be understood that the invention may be embodied otherwise without departing from such principles.

What is claimed is:

1. Device for the simultaneous tensional stressing of a plurality of elongated tension elements for prestressing a concrete member, such as rod-shaped tension elements where each tension element includes an anchor element mounted thereon and an anchor nut adjustably positionable on the tension element into engagement with the anchor element, a puller for each tension element, a mechanically driven spindle connected to each said puller, said spindle arranged to be connected to a tension element to be stressed, a mechanically driven wrench sleeve associated with each said spindle and arranged to adjust the anchor nut associated with the tension element to which said spindle associated with said wrench sleeve is arranged to be connected, a drive means for mechanically rotationally driving each of said spindles and each of said wrench sleeves, said drive means including a power source and a drive train connected to and extending between said power source and said spindles and wrench sleeves, and a safety clutch located in said drive train, wherein the improvement comprises that a separate said safety clutch is provided for each said spindle and each said wrench sleeve.

2. Device, as set forth in claim 1, wherein said drive means includes controls for selectively engaging said safety clutches for selectively transmitting the driving action from said power source to one of said spindles and said wrench sleeves.

3. A method of effecting simultaneous tensional stress of a plurality of elongated tension elements for prestressing a concrete member wherein a spindle is connected to each tension element for elongating it and a wrench sleeve is associated with the spindle for effecting a tightening action of an anchor nut against an anchor element on the tension element, the steps comprising automatically rotating a group of the spindles into engagement with the anchor nuts on a group of tension elements and discontinuing the rotational movement of individual ones of the spindles as the spindle contacts the anchor nuts independently of the rotation of the other spindles, disengaging the spindles from rotational movement and engaging the wrench sleeves for rotational movement, elongating the tension elements by pulling the spindles and at the same time rotating the wrench sleeves for maintaining the anchor nuts in engagement with the respective anchor elements and individually discontinuing the rotational movement of each wrench sleeve upon the completion of the tightening of each anchor nut against its respective anchor element independently of the rotational movement of the other wrench sleeves.

* * * * *